United States Patent [19]

Stout

[11] Patent Number: 5,029,698

[45] Date of Patent: Jul. 9, 1991

[54] BASKET-STYLE ARTICLE CARRIER HAVING HANDLE INTERLOCKING ELEMENTS

[75] Inventor: James T. Stout, Acworth, Ga.

[73] Assignee: The Mead Corporation, Dayton, Ohio

[21] Appl. No.: 574,666

[22] Filed: Aug. 29, 1990

[51] Int. Cl.[5] ..... B65D 75/56

[52] U.S. Cl. ..... 206/188; 206/187

[58] Field of Search ..... 206/188, 180, 175, 174, 206/170, 162, 187

[56] References Cited

U.S. PATENT DOCUMENTS

| | | | |
|---|---|---|---|
| 2,776,072 | 1/1957 | Forrer | 206/188 |
| 3,432,073 | 3/1969 | Forrer | 206/188 |
| 3,672,539 | 6/1972 | Forrer | 206/188 |
| 3,754,680 | 8/1973 | Wood | 206/188 |
| 4,217,983 | 8/1980 | Stout | 206/187 |
| 4,308,950 | 1/1982 | Wood | 206/188 |
| 4,374,561 | 2/1983 | Stout et al. | 206/188 |
| 4,480,746 | 11/1984 | Wood | 206/188 X |

*Primary Examiner*—Bryon P. Gehman

*Attorney, Agent, or Firm*—Rodgers & Rodgers

[57] ABSTRACT

An article carrier of the basket style includes a bottom wall, opposed side walls joined to the bottom wall along the side edges thereof, end wall panels joined to the ends of the side walls and with the inner edges thereof disposed medially of the carrier together with riser panels joined to the inner edges of the end wall panels and wherein handle structure of the telescopic type includes a pair of outer handle panels adjoined to riser panels at one end of the carrier and a pair of inner handle panels adjoined to riser panels at the other end of the carrier and a handle interlocking and reinforcing panel struck from one of the outer handle panels and projecting through an aperture formed in a face contacting inner handle panel and folded upwardly and secured to the inner handle panel to reinforce and interlock the handle elements with each other.

8 Claims, 4 Drawing Sheets

BASKET-STYLE ARTICLE CARRIER HAVING HANDLE INTERLOCKING ELEMENTS

TECHNICAL FIELD

This invention relates to articled carriers of the basket style wherein a telescoping reinforced handle structure is employed.

BACKGROUND ART

U.S. Pat. No. 2,776,072 issued Jan. 1, 1957 discloses a basket style article carrier having telescoping handle structure in which a reinforcing panel is struck from the handle structure and folded downwardly and secured in overlapping relation with the inner edges of riser panels at each end of the carrier.

U.S. Pat. No. 3,432,073 issued Mar. 11, 1969 discloses a basket style article carrier having telescoping handle structure in which the inner handle panels at one end of the carrier are foldably joined to riser panels along diagonal fold lines.

U.S. Pat. No. 4,217,983 issued Aug. 19, 1980 discloses a basket style article carrier having foldable handle structure rather than a telescopic handle in which a locking tab is utilized to secure a riser panel in place.

U.S. Pat. No. 4,480,746 issued Nov. 6, 1984 discloses an article carrier having foldable handle structure in which a reinforcing panel is struck from a medial panel of the carrier and folded so as to afford reinforcement for such panel.

SUMMARY OF THE INVENTION

According to this invention in one form, a basket style article carrier having telescoping handle structure utilizes a handle interlocking and reinforcing panel struck from an outer handle panel and folded inwardly through a hand receiving aperture in an inner handle panel and into flat face contacting relation with the inner surface of such inner handle panel and secured thereto with its upper edges in close proximity to a medial fold line between the inner handle panels so as to reinforce and interlock the handle elements into a mechanically strong and durable structure.

BEST MODE OF CARRYING OUT THE INVENTION

Figure 1:
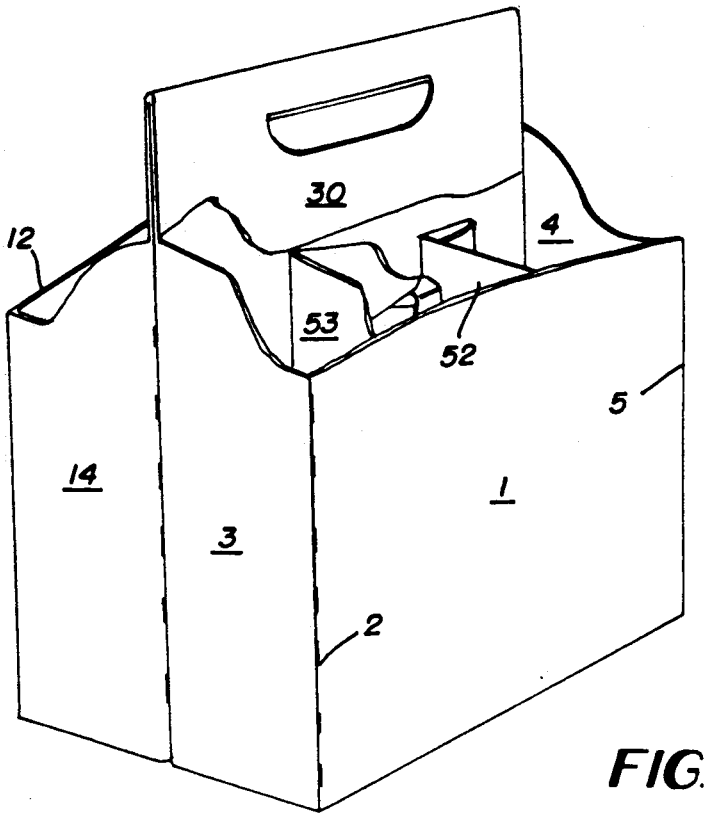
FIG. 1 is a perspective view of a set up carrier constructed according to the invention.

In the drawings, the numeral 1 depicts a side wall of the carrier to an end edge 2 of which an end wall panel 3 is foldably joined. End wall panel 4 is foldably joined to the opposite end edge 5 of side wall 1 while a glue flap 6 is foldably joined to the bottom edge of side wall 1 along a fold line 7. Riser panels 8 and 9 are foldably joined to end wall panels 3 and 4 along fold lines 10 and 11 respectively.

On the opposite side of the carrier, a side wall 12 is foldably joined along an end edge 13 thereof to an end wall panel 14 and at the other end of the carrier an end wall 15 is foldably joined to side wall panel 12 along fold line 16. A riser panel 17 is foldably joined to end wall panel 14 along fold line 18 and riser panel 19 is foldably joined to end wall panel 15 along fold line 20. Bottom panel 21 is foldably joined along fold line 22 to the bottom edge of side wall 12 and is provided with a medial fold line 23. A pair of notches 24 and 25 are formed at the ends of fold line 23 and cooperate in known manner with notches 26–29 formed in riser panels 8, 9, 17 and 19 respectively.

The handle structure of the carrier comprises a pair of full length outer handle panels 30 and 31 connected together along a medial fold line 32. Handle panel 30 is foldably joined to riser panel 8 along fold line 10 while handle panel 31 is foldably joined to riser panel 17 along fold line 18. Hand gripping apertures 33 and 34 are formed in outer handle panels 30 and 31 respectively.

According to this invention, a handle interlocking and reinforcing panel **34*a* is struck from outer handle panel 31 and is foldably joined to outer handle panel 31 by a pair of coaxial spaced apart fold lines 34*b* and 34*c*. A hand cushioning tab 34*d* is struck from handle interlocking and reinforcing panel 34*a* and is foldably joined to outer handle panel 31 by a fold line 34*e***. The function and beneficial effects of this structure are apparent from the folding and glueing operations performed during manufacture of the carton.

Medial reinforcing partition structure 35 is foldably joined both to riser panels 9 and 19 along diagonal fold lines 36 and 37 which are arranged in alignment with each other Hand gripping aperture **35*a* is formed in medial reinforcing partition structure 35 and a fold line 38 serves to separate the medial reinforcing partition structure into a pair of panels 39 and 40**.

For the purpose of providing transverse partitioning structure on the side of the carton adjacent the side wall 12, a medial strut 41 is formed integral with the riser panel 17. Transverse partitioning structure is secured to the medial strut 41 at short fold lines 42 and 43 and comprises a plurality of vertically disposed fold lines 44, 45 and 46. The transverse partitioning structure is secured to side wall 12 by simply affixing thereto by glue or another means the glue flap 47 and the small panel **48*a* which extends between fold lines 44 and 45. By arranging the transverse partitioning structure so that it straddles the medial fold line 32 areas of the blank opposite handle panels 30 and 31** are used and easy nesting of adjacent blanks is accommodated.

The transverse partitioning structure as depicted in the drawings is for the purpose of forming three cells between the handle and side wall 12 and constitutes a pair of transverse partition elements 48 and 49 which extend between the fold lines 44 and 45 and which in the assembled carrier are disposed in vertical alignment. A second transverse partitioning element is designated by the numeral 50 and extends between fold lines 45 and 46 and in the assembled carton extends transversely between the side wall 12 and the handle structure. The structure designated by the numeral 51 and which extends at its upper left hand edge from the fold line 45 above the transverse panel 50 and down to the fold line 43 as well as the small tab **51*a* defined by the bottom end of fold line 45 and the fold line 42** constitute medial panels which are disposed immediately underneath the handle panel and which are secured to the elements on the other side of the handle and which are disposed medially of the carrier.

In order to provide a combination medial transverse partitioning structure which is disposed between the side wall 1 and the handle, the riser panel 8 is enlarged substantially so as to provide a pair of transverse panels 52 and 53. Panel 53 is foldably joined along fold line 54 to riser panel 8 and is provided with a glue flap 55 which is foldably joined along fold line 56 to the transverse panel 53. Thus with the glue flap 55 secured in flat face contacting relation in an appropriate position to the inner surface of side wall 1, panel 53 is disposed transversely with respect to the carrier and aids in defining a pair of cells.

In like fashion, transverse partition element 52 is foldably joined to riser panel 8 along fold lines 57 and 58 and is provided with a pair of glue flaps 59 and 60 which foldably joined respectively to transverse partition 52 long fold lines 61 and 62. Thus glue flaps 59 and 60 affixed in an appropriate position to the inner surface of side wall 1 and transverse element 52 aids in forming a partition between a pair of adjacent cells on one side of the carrier.

In order to provide medial separation and support for the carrier, a keel panel 63 is foldably joined along fold line 64 to a part of riser panel 8 and to the small tab to the right of fold line 57 and above the transverse panel 53. Of course the keel panel 63 is severed by cut lines from transverse panels 52 and 53 as best shown in FIG. 2.

Figure 2:
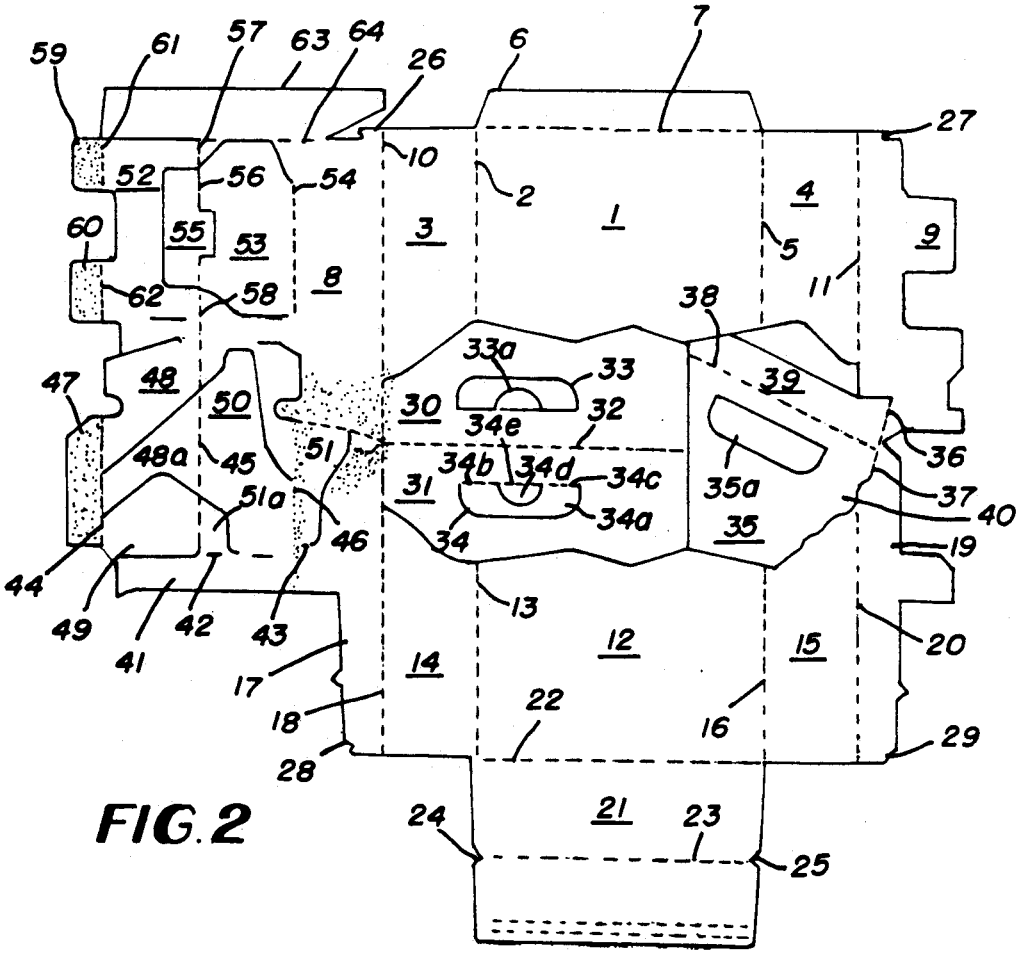
FIG. 2 is a plan vie of a unitary blank from which the carrier of FIG. 1 is formed.
Figure 3:
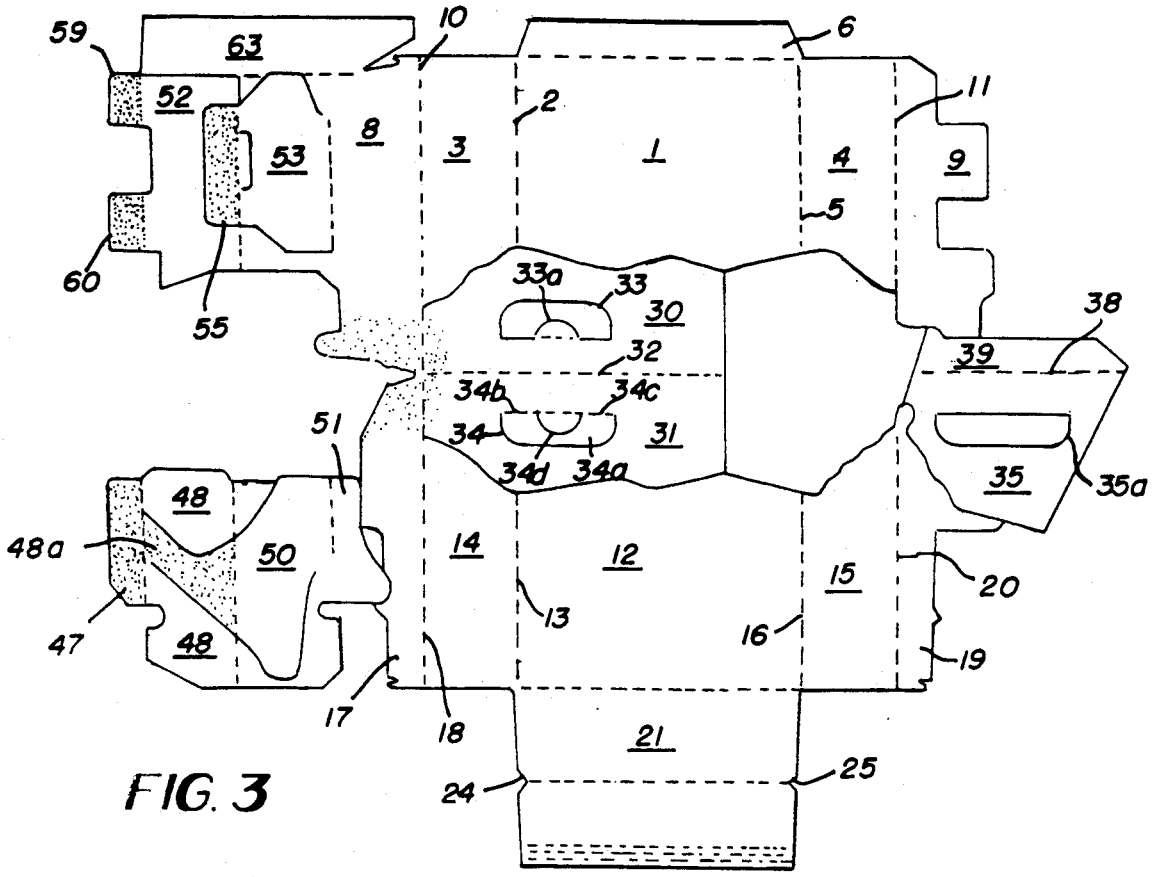
FIGS. 3–7 depict various glueing and folding operations performed on the blank shown in FIG. 2 in order to form a complete collapsed carrier as depicted in FIG. 8.

In order to perform the first folding operation, an application of glue is made to the blank depicted in FIG. 2 as indicated by stippling in the region adjacent the fold lines 43 and 46 and the transverse partitioning structure comprising panels 48, 50 and associated structure is swung forwardly and downwardly about the fold lines 42 and 43 to occupy the position depicted in FIG. 3. In like fashion, the medial reinforcing partition 35 is folded upwardly and outwardly along the fold lines 36 and 37 to occupy the position depicted in FIG. 3.

Figure 4:
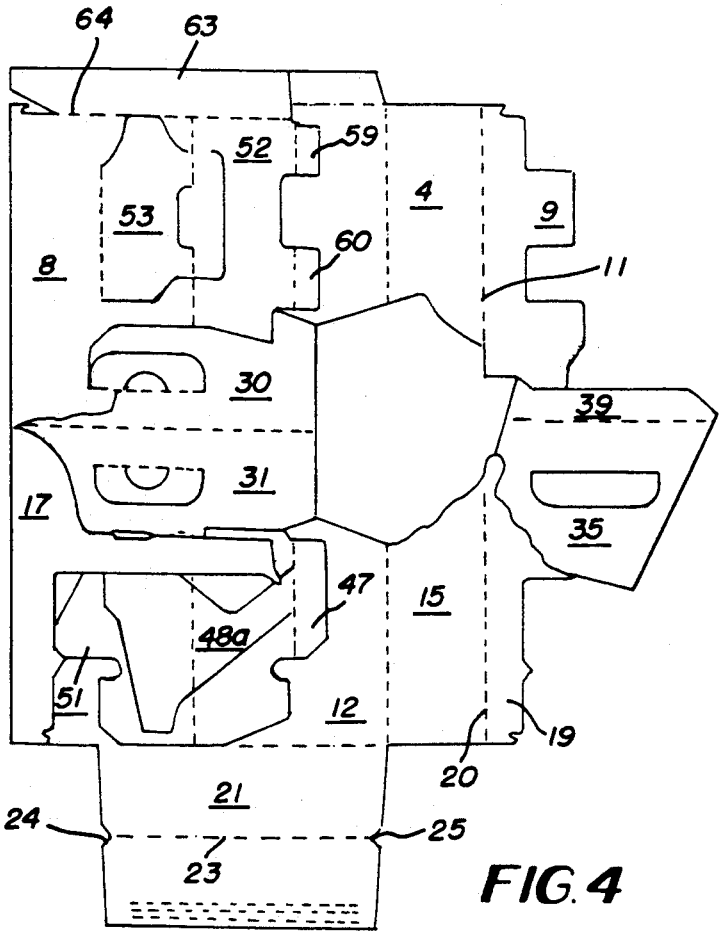

An application of glue is then made to the blank depicted in FIG. 3 as indicated by stippling in that figure. The next folding operation results in structure as depicted in FIG. 4 and simply constitutes swinging the riser panels 8 17 upwardly and toward the right along the fold lines 10 an 18 respectively. Such operation of course causes the transverse partitioning structure including panels 48 and 50 and associated elements as well as the medial strut 41 to swing over into face contacting relation with side wall 12 and simultaneously the combination medial and transverse partitioning structure associated with riser panel 8 falls into flat face contacting relation with the side wall 1. This folding operation causes the riser panel 8 to adhere to the inner surface of the left hand end of handle panel 30 and also causes the riser panel 17 to adhere to the inner surface of outer handle panel 31. In like fashion, the glue flap 47 and the panel **48*a* are affixed to the inner surface of side wall 12. Of course glue flaps 59 and 60 as well as glue flap 55 become adhered to the inner surface of side wall 1 upon completion of the folding operation depicted in FIG. 4**.

Figure 5:
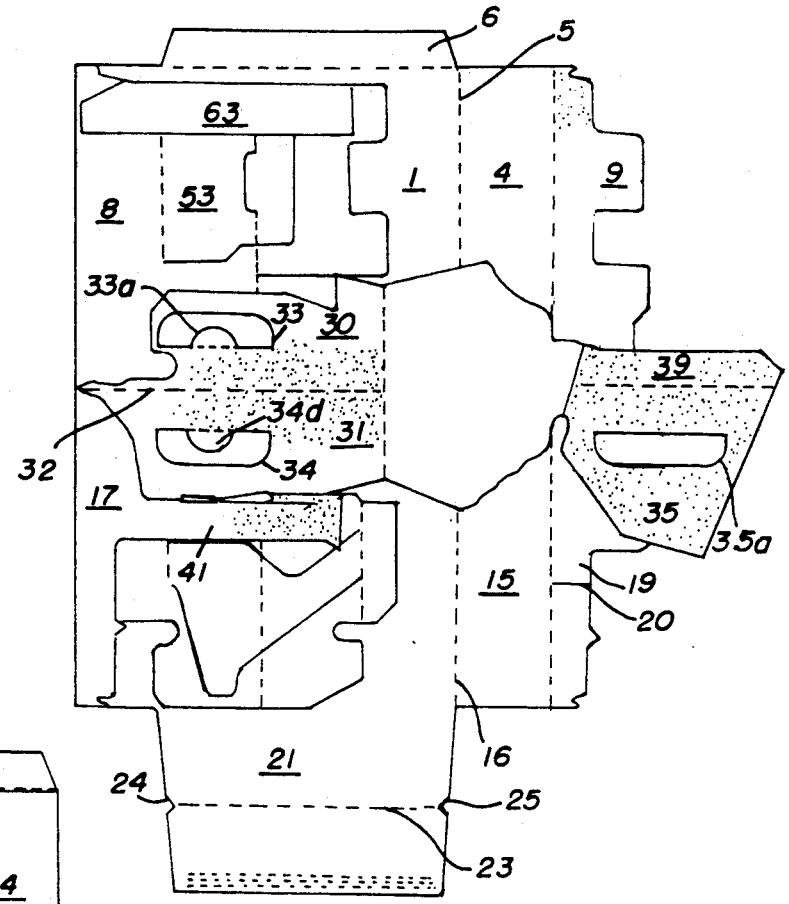

The keel panel 63 is then folded upwardly and forwardly from the position depicted in FIG. 4 to that depicted in FIG. 5 and the blank then appears as depicted in FIG. 5.

An application of glue is then made to the blank depicted in FIG. 5 as indicated by stippling on the right hand end of the keel panel 63 the bottom end of riser panel 9, medial reinforcing partition 35 and the inner surfaces of handle panels 30 and 31 and of medial strut 41. The end panels 4 and 15 are then lifted upwardly and swung toward the left along their respective fold lines 5 and 16 so as to swing the medial reinforcing partition 35 into flat face contacting relation with the inner surface of the handle panels 30 and 31 and so as to cause the stippled surface of riser panel 9 to adhere to the right hand end of keel panel 63. Simultaneous the lower downwardly protruding tip of medial reinforcing partition 35 is adhered to medial strut 41 as is the upper and of riser panel 19.

Figure 6:
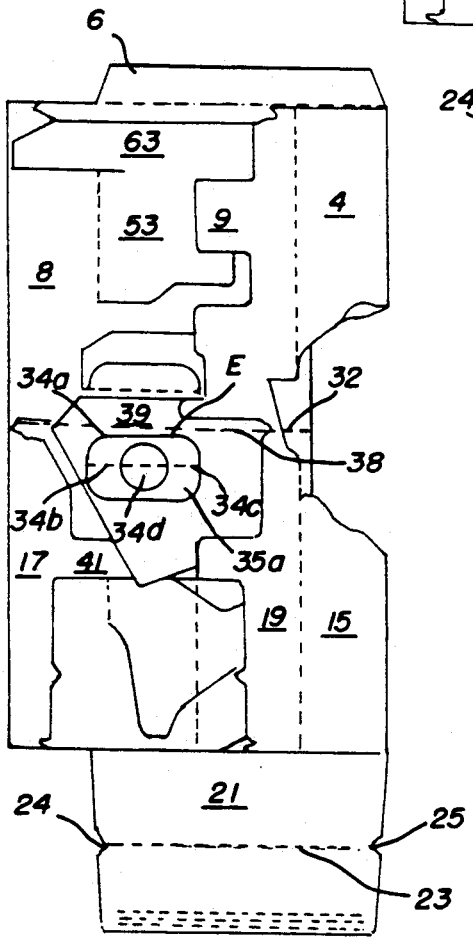

It is apparent that the diagonal disposition of medial partition 35 as shown in FIG. 2 results in structure as shown in FIG. 6 which completely interconnects the riser panels 9, 19 with riser panels 8 and 17 and also affords a full hand hole **35*a* which coincides with hand gripping aperture 34 and with the handle interlocking and reinforcing panel 34*a***.

The blank as depicted in FIG. 6 is then manipulated by pushing the handle interlocking and reinforcing panel **34*a* through hand gripping aperture 35*a* and folding it over into flat face contacting relation with the inner surface of inner medial handle panel 35 and by glueing it thereto. At the same time bottom panel 21 is folded medially along its fold line 23 by simply elevating the lowermost portion of panel 21 upwardly and forwardly so that the lower portion of bottom wall 21 is disposed in flat face contacting relation with the upper portion thereof. The blank then appears as depicted in FIG. 7**.

Figure 7:
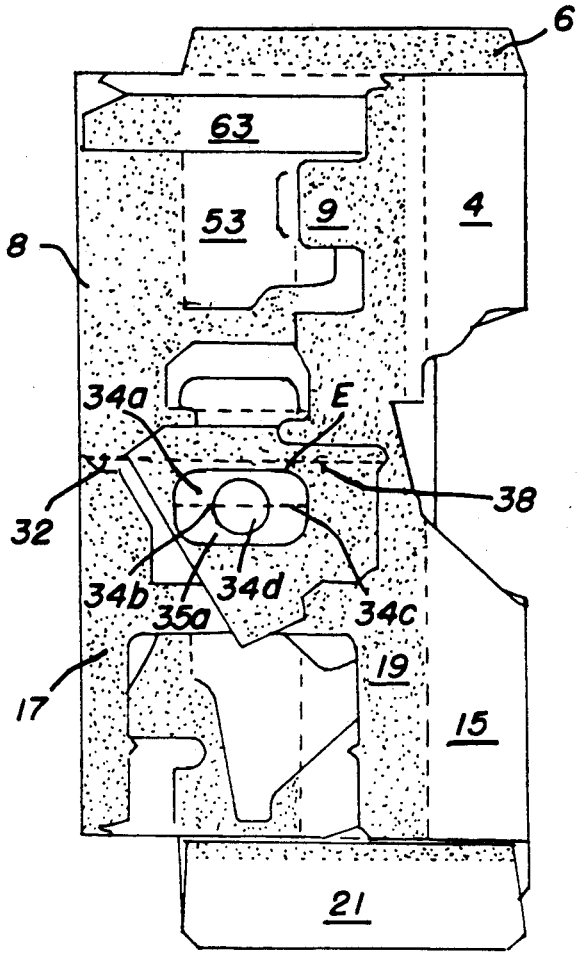
Figure 8:
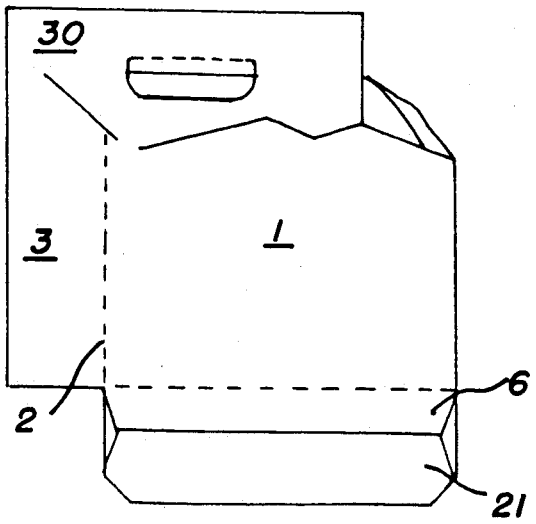

An application of glue is then made to the blank as depicted in FIG. 7 at the places indicated by stippling and the handle panel 30, side wall 1 and parts associated therewith are lifted and folded forwardly along the fold lines 32, 38 so that the blank then appears in completed collapsed form as shown in FIG. 8. Of course the glue flap 6 is adhered to the upper edge of bottom wall 21 and the corresponding areas disposed symmetrically on opposite sides of the fold lines 32 and 38 become adhered to each other to form a medial partition for the carrier immediately below the handle. Handle interlocking and reinforcing panel **34*a* is adhered to the inner surface of panel 35**.

According to this invention, the upper edge of handle interlocking and reinforcing panel **34*a* is closely spaced with respect to fold line 38 and the outer handle panel 31 to which handle interlocking and reinforcing panel 34*a* is foldably joined is fixed in position relative to inner handle panel 35 to which panel 34*a*** is secured. By this means the carrier handle is substantially reinforced and the handle elements are effectively interlocked during the formation of the carrier and the completed carrier is substantially strengthened.

I claim:

1. An article carrier having a bottom wall, opposed side walls joined to said bottom wall along the side edges thereof, end wall panels joined to the ends of said side walls and extending transversely inward therefrom with the inner edges thereof disposed medially of the carrier at each end thereof, riser panels joined to the inner edges of said end wall panels, the riser panels at each end of the carrier being secured together in flat face contacting relation, a pair of outer handle panels foldably joined to the riser panels at one end of the carrier along fold lines which are substantially coincidental with each other and with the inner edges of the adjacent end wall panels, a handle interlocking and reinforcing panel struck from and defining a first hand gripping aperture in one of said outer handle panels, a first medial reinforcing inner handle panel foldably joined to a riser panel at the other end of the carrier and having a second hand gripping aperture formed therein and disposed in general coincidence with said first hand gripping aperture and with said handle interlocking and reinforcing panel projecting through said second hand gripping aperture and secured in flat face contacting relation with the inner surface of said medial reinforcing inner handle panel.

2. An article carrier according to claim 1 wherein said interlocking and reinforcing panel is secured in flat face contacting relation with the inner surface of said medial reinforcing inner handle panel by adhesive.

3. An article carrier according to claim 1 wherein said outer handle panels are adjoined to each other along a medial fold line and wherein the upper edge of said handle interlocking and reinforcing panel is disposed in generally parallel spaced relation to said medial fold line adjoining said outer handle panels to each other.

4. An article carrier according to claim 1 wherein a second medial reinforcing inner handle panel is foldably joined to a riser panel at the other end of the carrier and to said first medial reinforcing inner handle panel along a medial fold line and wherein the upper edge of said handle interlocking and reinforcing panel is disposed in closely spaced generally parallel relation with said medial fold line adjoining said first and second inner handle panels.

5. An article carrier according to claim 4 wherein said inner and said outer handle panels are arranged in telescoping relation to each other.

6. An article carrier according to claim 1 wherein said handle interlocking and reinforcing panel is foldably joined to said one outer handle panel by a pair of coaxial spaced apart fold lines.

7. An article carrier according to claim 6 wherein a hand cushioning tab is struck from said handle interlocking and reinforcing panel and foldably joined to said one outer handle panel along a fold line which is coaxial with and interposed between said pair of coaxial spaced apart fold lines.

8. An article carrier according to claim 1 wherein said handle interlocking and reinforcing panel is secured above said first and second hand gripping apertures.

* * * * *